United States Patent [19]

Regan

[11] 3,990,380

[45] Nov. 9, 1976

[54] STABILIZING AND SUPPORTING STRUCTURE FOR A MULTI-HULL BOAT

[76] Inventor: Joseph D. Regan, Box 243, Roseland, Fla. 32957

[22] Filed: Aug. 25, 1975

[21] Appl. No.: 607,340

[52] U.S. Cl. ..... 114/61

[51] Int. Cl.[2] ..... B63B 1/12

[58] Field of Search ..... 114/56, 61, 81, 83; 9/2 S, 2 R; 115/22, 26

[56] References Cited

UNITED STATES PATENTS

| | | | |
|---|---|---|---|
| 3,524,422 | 8/1970 | Fuller | 114/61 |
| 3,810,268 | 5/1974 | Weihe | 9/2 R |
| 3,846,858 | 11/1974 | Syfritt | 114/61 |

*Primary Examiner*—Trygve M. Blix
*Assistant Examiner*—Stuart M. Goldstein

[57] ABSTRACT

A basic supporting and interconnecting structure for attaching separate floats or hulls to one another or to a main hull of a catamaran or trimaran boat. Generally, the structure comprises four tetrahedrons mounted horizontally perpendicular to a vertical fore and aft centerline plane of the boat and sharing one common central vertical member or edge, defining the points of a regular or irregular octahedron. The eight edges radiating from the central vertical member form a system of diagonal bracing between the opposite ends of the separate floats, the two floats serving as the edges of the octahedron parallel to the centerline of the boat.

7 Claims, 7 Drawing Figures

STABILIZING AND SUPPORTING STRUCTURE FOR A MULTI-HULL BOAT

BACKGROUND OF THE INVENTION

Throughout much of man's naval history he has sought more efficient means of sailing for reasons among others of going faster, providing more comfort, and having broader access to shallow areas of water. A significant gain came with the elimination of ballast and its attendent disadvantages of unusable displacement and extra draft. The progression to floats or pontoons instead of ballast to counteract the force of the wind added one more advantage to those of speed and manuverability. It reduced the heeling angle of a sailboat and made life on board more comfortable. These new craft took on two major forms: trimarans, which utilize a main hull with floats on each side, and catamarans, which eliminate the middle hull entirely and rely on the floats alone for support.

With the floats came new problems, however. The increased overall beam (width) and necessary structure of attachment exposed more area to action and loads from the sea. The considerable stresses imposed on the floats and connecting structure under storm conditions has caused the breakup of a number of craft and the emphasis on light weight has sometimes gone counter to the desire for strength.

Forces at work on these multi-hull craft have not been sufficiently analysed nor float attachment superstructures designed which accurately and efficiently resist the stresses which they encounter. A boat in a seaway is subject to many diverse forces and loads. As referred to here roll is a transverse movement about the fore and aft centerline axis of the boat, yaw is lateral movement about the vertical centerline axis, and pitch is a longitudinal movement about the beam axis horizontally perpendicular to the fore and aft centerline. In a multi-hull boat the means for countering roll is the floats which effect a broad base to resist the side heeling forces. Pitch is countered by the bouyancy of the ends of both floats and, if applicable, main center hull. Yaw is countered by a combination of the other two means. Traditionally the load carrying connecting members have been spars or solid decking running transversely from float to float. In neither of these methods is any emphasis given to diagonal bracing.

Sea conditions, in reality, rarely put the craft in purely defined parallel or right angle to the centerline motion or loads. Instead the forces add in a resultant vector of varying angles. A multi-hull not only carries these loads over its length and width but diagonally between the opposite tips of its seperate floats, as when the bow of one and the stern of the other are each supported by wave crests with a trough in betweem. As a crest passes from bow to stern so does the loading and, in fact, acts through a complete 360° range. The traditional transverse wing deck or strut frame crossing from float to float at a right angle to the centerline is not stable in a diagonal or three dimensional axis. The floats and edges of this connecting structure form a parallelogram, instable in either a horizontal or vertical centerline plane. It is necessary that this structure connecting the parallel hulls have three dimensional integrity, free from warping or shear.

SUMMARY OF THE INVENTION

This invention, while employing two more or less transverse cross members, relies primarily on a three dimensional, diagonal system of braces of octahedronal shape. A pair of tetrahedrons project horizontally from each side of the vertical centerline plane, with a base triangle of each lying in that plane and a vertex of each at the floats. The four tetrahedrons intersect each other in a common central vertical edge at the intersection of the diagonals so as to not only in cross connection form a transverse structure, but when interconnected centrally and diagonally and in conjunction with the floats define an octahedron—a simple, stable geometric structure. The effect is to make the entire system of floats and joining structure act as a cohesive unit to isolate the floats and center hull from movement outside their designed parallel condition.

It is therefore an object of the present invention to provide a stabilizing and supporting structural network for a multi-hull boat wherein the stabilizing and supporting structural network is capable of withstanding load forces and stresses commonly encountered by such boats which move through water or sea water.

DESCRIPTION OF THE PREFERRED EMBODIMENTS

Figure 1:
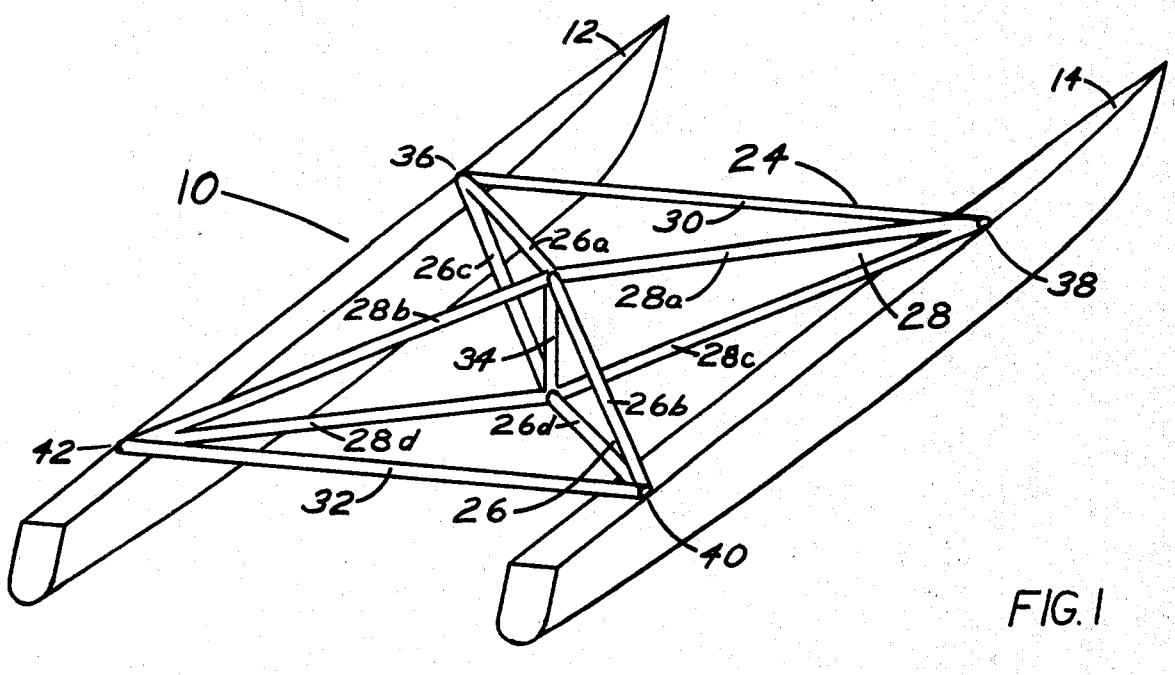
FIG. 1 is a perspective view of a cataraman boat having the stabilizing and supporting structural network of the present invention incorporated therein.
Figure 2:
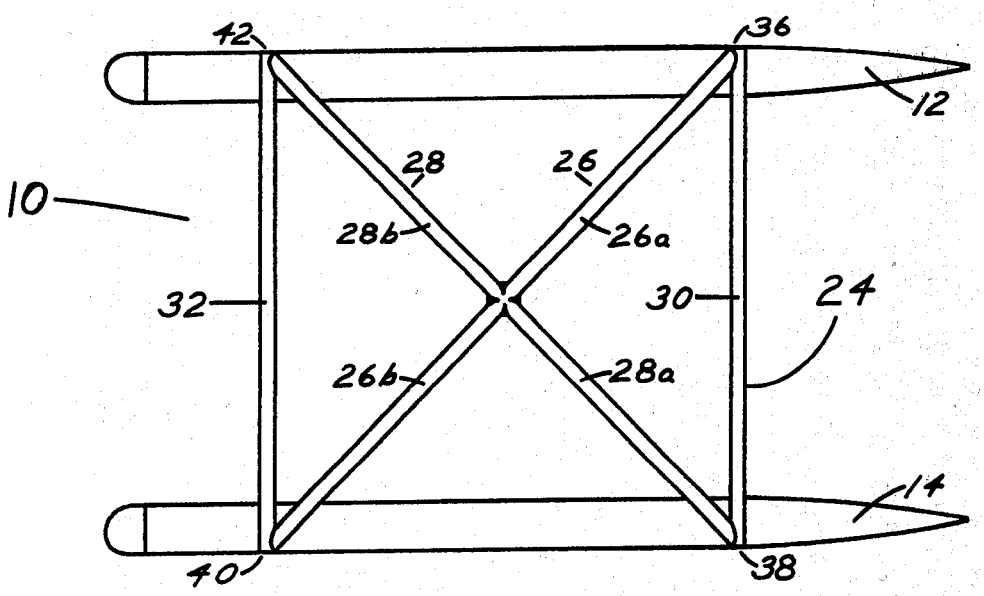
FIG. 2 is a top plan view of the cataraman boat and the associated stabilizing and supporting structural network shown in FIG. 1.
Figure 3:
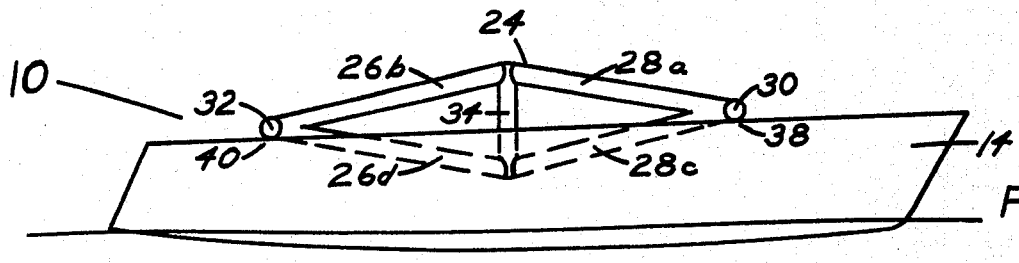
FIG. 3 is a side elevated view of the cataraman boat and the associated stabilizing and supporting structural network shown in FIG. 1.
Figure 4:
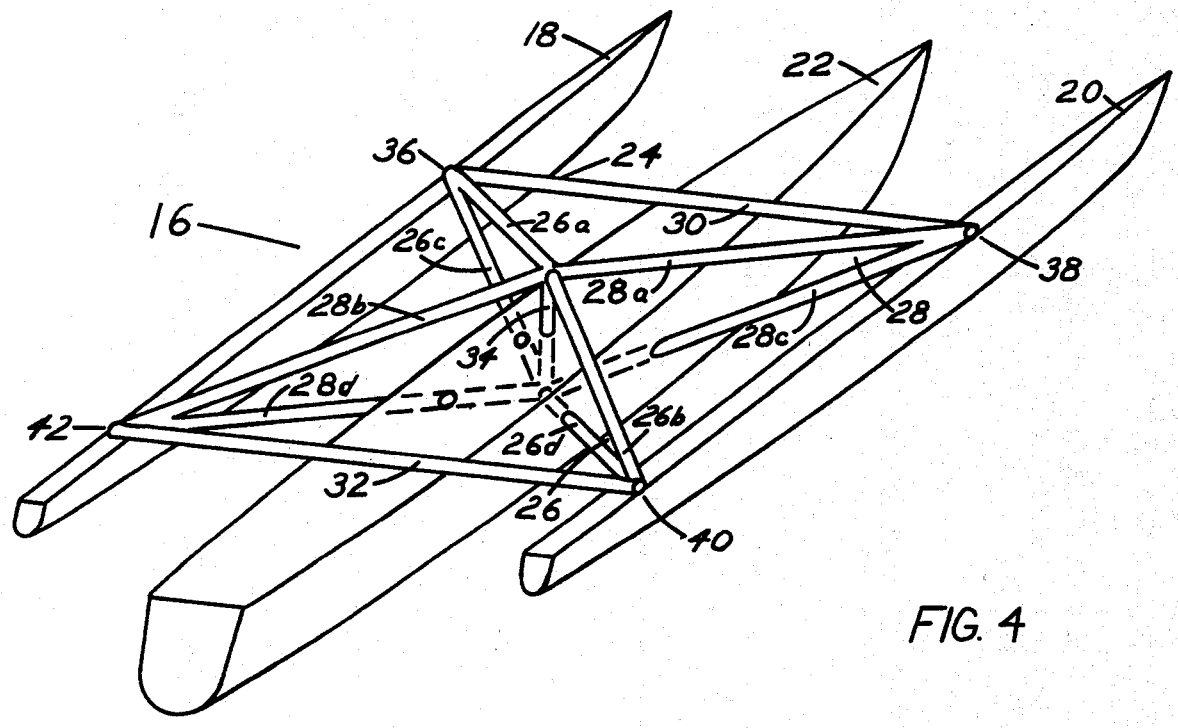
FIG. 4 is a perspective view of a trimaran boat having the same general stabilizing and supporting structural network design of the present invention incorporated therein.

With further reference to the drawings, particularly FIGS. 1 and 4, there is shown therein the basic configuration of catamaran and trimaran boats, the catamaran being illustrated in FIG. 1 and indicated generally by the number 10 while the trimaran is shown in FIG. 4 and indicated generally by the number 16.

First, in the way of a brief description, the catamaran comprises a pair of laterally spaced hulls or floats 12 and 14 that are disposed generally parallel relative to each other. Floats or hulls 12 and 14 of the catamaran boat are interconnected by a stabilizing and supporting structural network indicated generally by the number 24, which will be described subsequently herein in greater detail.

The trimaran 16 is of the same basic form as the catamaran except the same encloses a center hull 22 that is spaced between the hulls or floats 18 and 20, as particularly illustrated in FIG. 4 and including a generally similar interconnecting stabilizing and supporting structural network 24.

Now turning to a description of the stabilizing and supporting structure 24 which is applicable to both the catamaran and trimaran boats, it is seen that the same structure 24 basically comprises a first diagonal structural assembly 26 which is intersected generally centrally by a second diagonal structural assembly 28. Furthermore, the stabilizing and supporting structure 24 includes a front cross member 30 and a rear cross member 32, both of which extend transversely between the front and rear respective ends of the first and second diagonal structural assemblies 26 and 28 respectively.

In greater detail, the first diagonal structural assembly 26 comprises upper elongated members 26*a* and 26*b* and lower elongated members 26*c* and 26*d*. The second diagonal structural assembly 28 comprises upper elongated members 28*a* and 28*b* and lower elongated members 28*c* and 28*d*. Thus, in the embodiment shown in FIG. 1, both diagonal structural assemblies 26 and 28 are of a open strut construction as the respective upper and lower members of each extend so as to define an open area between the respective upper and lower members of each diagonal structural assembly. Further, upper elongated member 26*a* and lower elongated member 26*c* merge to form corner vertex 36, upper elongated member 28*a* and lower elongated member 28*c* merge to form corner vertex 38, upper elongated member 26*b* and lower elongated member 26*d* merge to form corner vertex 40, and upper elongated member 28*b* and lower elongated member 28*d* merge to form corner vertex 42. The front cross member 30 extends transversely between corner vertexes 36 and 38, and the rear cross member 32 extends transversely between corner vertexes 40 and 42.

The same stabilizing and supporting structure 24 additionally comprises a generally vertical member 34 at the intersection of the first diagonal structural assembly 26 and second diagonal structural assembly 28 extending between the intersections of upper elongated members 26*a*, 26*b*, 28*a*, 38*b*, and lower elongated members 26*c*, 26*d*, 28*c*, 28*d*.

The method of attachment for joining the different members at the intersections and vertexes may be of any suitable structural means such as weldment, bolts, or other satisfactory fastening means.

Figure 5:
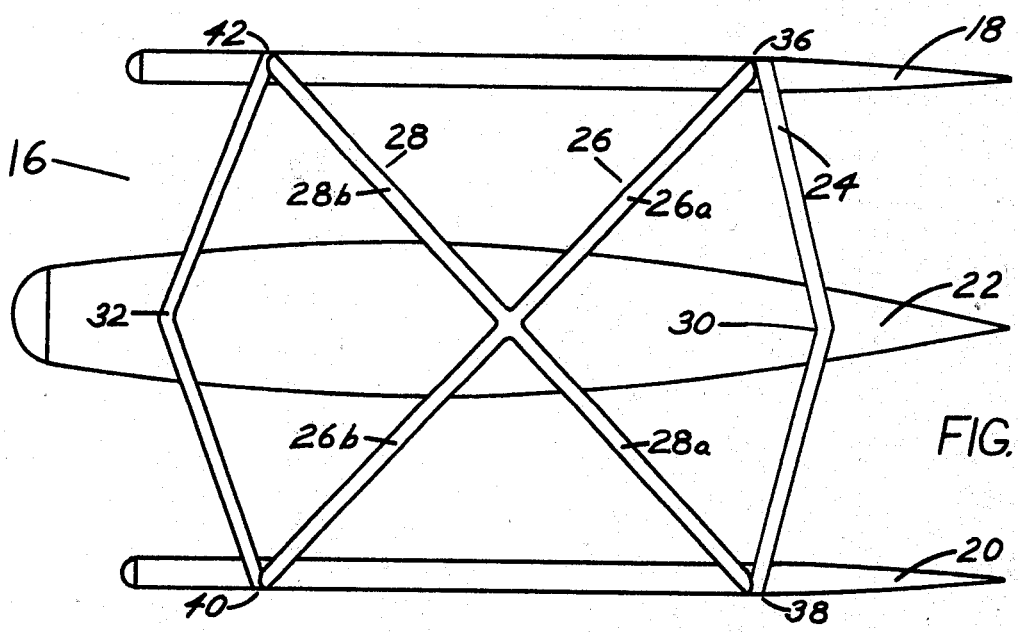
FIG. 5 is a top plan view of a trimaran boat wherein the inherently same basic stabilizing and supporting structural network is altered such that the front and rear cross members are angled outwardly relative to the central area of said structural network.

Now referring to FIG. 5, an example of an alternate design is shown for the basic stabilizing and supporting structure 24 wherein the rear cross member 32 and front cross member 30 are bent outwardly relative to the central area of the structural network to form a generally irregular octahedronal design.

Figure 6:
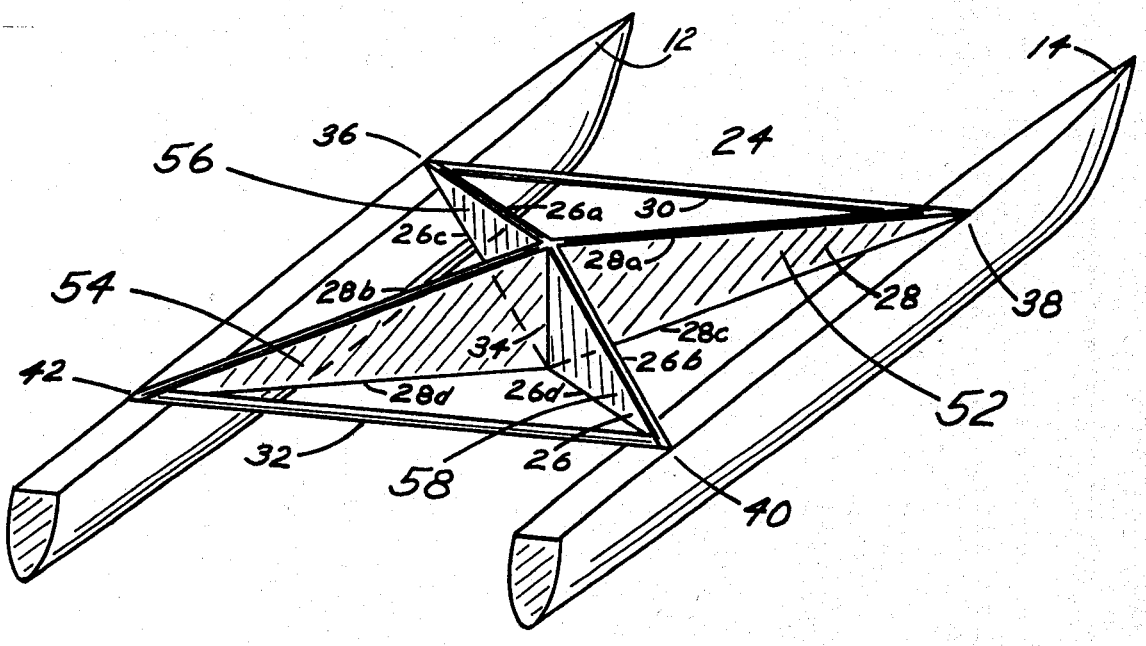
FIG. 6 is a perspective view of a catamaran boat wherein the same basic stabilizing and supporting structural network is altered such that the open strut construction is enclosed by vertically oriented side panel assemblies extending between the upper and lower members of the respective diagonal structural assemblies to form a closed construction design.
Figure 7:
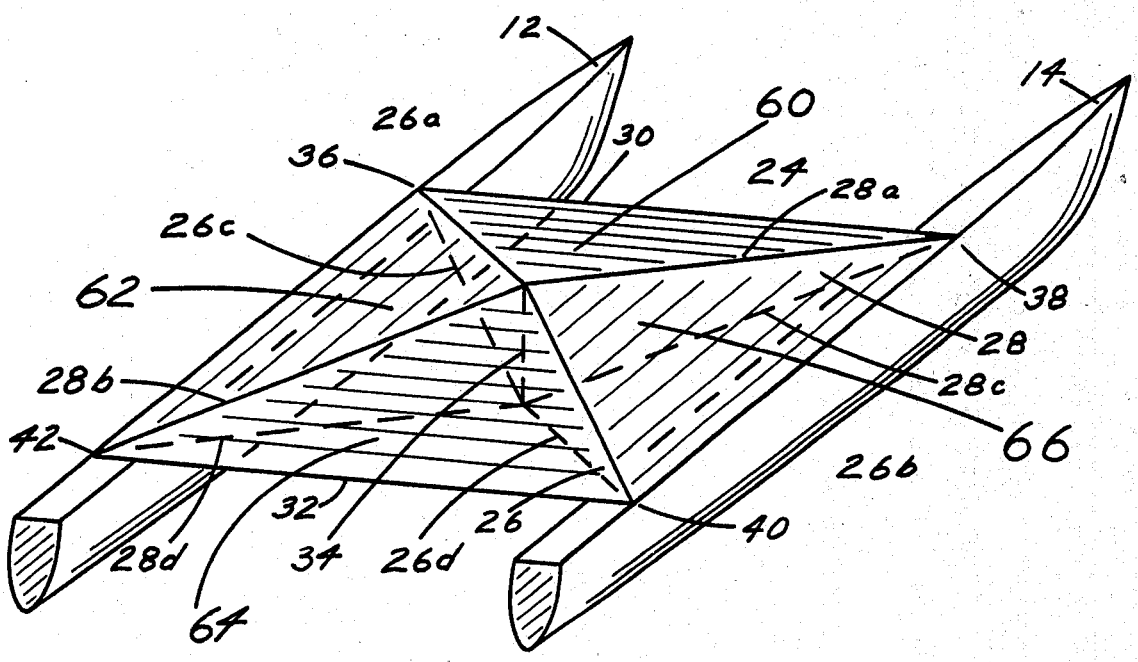
FIG. 7 is a perspective view of a catamaran boat wherein the stabilizing and supporting structural network is closed about the general top portions thereof by panel assemblies filling the four generally open top areas defined about the intersection of the two diagonal structural assemblies to form another closed construction design.

FIGS. 6 and 7 are seen also to be examples of alternate designs for the basic stablizing and support structure 24 wherein the open strut construction or that basic frame structure shown in FIG. 1 is closed by the presence of panel structures or panel assemblies extending between various members comprising the diagonal structural assemblies 26 and 28.

In FIG. 6, an example of this alternate design of the basic stablizing and supporting structure 24 is shown wherein the first and second diagonal structural assemblies 26 and 28 include a side structure or a series of side panels or sides 52, 54, 56, and 58. Each respective side panel or side assembly just referred to extends in a general vertical plane and between respective upper and lower members of each diagonal structural assembly 28.

With reference to FIG. 7, another example of an alternate design for the basic stablizing and supporting structure 24 is shown wherein the four generally open top areas formed adjacent the intersection of the first and second diagonal structural assemblies 26 and 28 are altered by providing panel structures or panels between the upper members 28a and 26a, 28a and 26b, 26b and 28b, and 28b and 26a. In particular, in FIG. 7, these panels or panel assemblies are referred to by Reference Numerals 60, 62, 64, and 66. It is, therefore, appreciated that with this type of closed construction provided for in the embodiment shown in FIG. 7, that the general top planar portion of the catamaran boat are of a closed construction. Likewise panels or sides could be provided between the respective lower members of the two diagonal structural assemblies 26 and 28.

This invention is not to be limited in strict detail to the exemplary embodiments described herein, but is meant to cover a basic structural design of a generally octahedronal shape including a pair of diagonal structural assemblies arranged between the outer two respective hulls or floats of the boat embodied therein. Varations in strut length and angles, construction, size and shape, methods of attachment and other detail changes in the basic design are not to be construed as limiting or restricting the present invention. Although this structure is not intended primarily to be of the retractable or folding type, those skilled in the art will appreciate that the basic structural design may be constructed to fold, telescope, or dismantal without departing from the basic geometrical design and of the structural design of the present invention.

The terms "upper", "lower", "forward", "rearward", etc., have been used herein merely for the convenience of the foregoing specification and in the appended claims to describe the supporting and stabilizing structural network for multi-hull boats and its parts as oriented in the drawings. It is to be understood, however, that these terms are in no way limiting to the invention since the supporting and stabilizing structural network for multi-hull boats may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A stabilizing and supporting structural network of a generally octahedronal geometric shape for interconnecting at least two laterally spaced buoyant members of a catamaran or trimaran boat, said interconnecting structural network comprising: a first diagonal structural assembly extending diagonally across and between said laterally spaced buoyant members with one end of said first diagonal structural assembly being secured to an area on one of said buoyant members forwardly of the area of securement of the other end thereof to the other buoyant member, said first diagonal structural assembly including upper and lower edges that extend entirely across and between the respective buoyant members with the distance between the respective upper and lower edges generally increasing from the respective areas of securement to said buoyant members to generally the central area of said first diagonal structural assembly; a second diagonal structural assembly extending diagonally across and between said buoyant members at an angle to the plane of said first diagonal structural assembly such that said first and second diagonal structural assemblies intersect generally about midway between the respective structural assemblies and wherein one end of said second diagonal structural assembly is secured to an area on one of said buoyant members forwardly of the area of securement of the other end thereof to the other buoyant member, said second diagonal structural assembly including upper and lower edges that extend entirely across and between the respective buoyant members with the distance between the respective upper and lower edges thereof generally increasing from the respective areas of securement to said buoyant members to generally the central area of said second diagonal structural assemblies; a forward cross member secured across said buoyant members generally between the forward areas of securement of said first and second diagonal structural assemblies; and a rearward cross member secured across said buoyant members generally between the rearward areas of securement of said first and second diagonal structural assemblies.

2. The stabilizing and supporting structural network interconnecting at least two laterally spaced buoyant members of claim 1 wherein there is provided a central vertical member about the vertical intersection of said first and second diagonal structural assemblies.

3. The stabilizing and supporting structural network for interconnecting at least two laterally spaced buoyant members of claim 2 wherein said first and second diagonal structural assemblies are of an open strut construction with each including upper and lower elongated members that extend entirely across and between the respective buoyant members and are generally disposed in a common vertical plane.

4. The stabilizing and supporting structural network for interconnecting at least two laterally spaced buoyant members of claim 3 wherein the upper and lower elongated members of each diagonal structural assembly merge about the opposite ends of each and further merge with an appropriate end of a respective front or rear cross member to form a corner vertex of the structural network.

5. The stabilizing and supporting structural network for interconnecting at least two laterally spaced buoyant members of claim 4 wherein both said front and rear cross members are bent about an intermediate point between the respective ends thereof to form an angle that extends outwardly of said structural network relative to said vertical central member that is disposed generally about the points of intersection between said first and second diagonal structural assemblies.

6. The stabilizing and supporting structural network for interconnecting at least two laterally spaced buoyant members of claim 1 wherein said first and second diagonal structural assemblies are of a closed construction with each structural assembly having a vertically oriented side structure that extends between said upper and lower edges thereof to form the closed construction.

7. The stabilizing and supporting structural network for interconnecting at least two laterally spaced bouyant members of claim 1 wherein said first and second diagonal structural assemblies form four open areas about the intersection thereof, and wherein each open area about this intersection of said diagonal assemblies is at least partially closed by the presence of a panel structure extending between respective portions of said diagonal assemblies.

* * * * *